US006166623A

United States Patent [19]

Coward

[11] Patent Number: 6,166,623

[45] Date of Patent: Dec. 26, 2000

[54] MODULAR ALARM ASSEMBLY

[75] Inventor: Mark T. Coward, Boise, Id.

[73] Assignee: Electronics Controls Company, Boise, Id.

[21] Appl. No.: 09/472,278

[22] Filed: Dec. 22, 1999

[51] Int. Cl.[7] ..... M01M 37/46

[52] U.S. Cl. ..... 340/384.1; 340/384.6; 340/384.73; 340/388.1; 340/391.1

[58] Field of Search ..... 340/384.1, 384.6, 340/384.73, 388.1, 391.1, 425.5, 426

[56] References Cited

U.S. PATENT DOCUMENTS

| | | | |
|---|---|---|---|
| 3,736,632 | 6/1973 | Barrow | 29/25.35 |
| 4,558,305 | 12/1985 | Black et al. | 340/384 E |
| 4,603,317 | 7/1986 | Gailbreath et al. | 340/70 |
| 4,700,177 | 10/1987 | Nakashima et al. | 340/388 |
| 4,813,123 | 3/1989 | Wilson et al. | 29/593 |
| 4,994,800 | 2/1991 | Milliken | 340/901 |
| 5,073,948 | 12/1991 | Vandersteen | 381/192 |
| 5,414,406 | 5/1995 | Baxter | 340/388.1 |
| 5,568,118 | 10/1996 | Andersen et al. | 340/384.1 |
| 5,953,436 | 9/1999 | Zimmerman | 381/396 |

*Primary Examiner*—Daniel J. Wu
*Assistant Examiner*—Tai T. Nguyen
*Attorney, Agent, or Firm*—Joseph W. Holland

[57] ABSTRACT

A modular audible warning device includes a primary housing which houses the core components of an audible warning device: a transducer and control circuitry. In one embodiment of the invention, the primary housing is insertable within a variety of secondary housings having a variety of configurations in order to accommodate the demand for differing product configurations and applications. Additionally, the primary housing may be adapted for direct mounting within an aperture formed within a planar member, for instance, a body panel or bumper.

17 Claims, 11 Drawing Sheets

MODULAR ALARM ASSEMBLY

BACKGROUND OF THE INVENTION

1. Technical Field

The present invention relates generally to the assembly of audible warning devices and more particularly to a device and a method for the assembly of a modular alarm.

2. Background

Alarms including electromechanical horns are currently employed for a wide range of uses, including providing audible warning signals for machinery applications, particularly vehicular and mobile applications.

Audible alarms typically include circuitry for generating an audible tone and a transducer or driver supported within a housing for emitting the generated tone. The circuitry for generating an audible tone is typically configured as a printed circuit board conductively supporting the required electronic components. The driver typically includes a flexible diaphragm, fixed at the outside edge to a basket, and a magnet connected to the support structure which concentrates the magnet's field. An electromagnetic coil encircles an iron slug. The electromagnetic coil is electrically connected to a power supply through a set of conductive contacts. The alarm housing may be configured to include an acoustic horn for efficiently broadcasting and directing the tone.

Although most every alarm typically includes each of these basic components, a variety of configurations of alarms may be offered by any given manufacturer in order to accommodate a variety of customer desires or application objectives.

For instance, housings may be configured in a variety of shapes and sizes. Housings may be configured so as to permit a forward orientation of the transducer in relation to the face of the housing, or the housing may be configured so as to permit a rearward orientation of the transducer in relation to the face of the housing. Additionally, the alarm may be configured to include circuitry for generating an audible tone at a single preselected level or in the alternative, the sound level may be selectable or automatically adjustable. The alarm may be adapted to a wide variety of installation applications employing a variety of connectors for electrically connecting the alarm to a power supply including a vehicle's existing wiring harness.

Applying current state of the art for manufacturing, a large number of alarms having a wide variance of configurations and features must be manufactured in order to accommodate the widespread demand for differing configurations and applications.

SUMMARY OF THE INVENTION

According to the present invention, a modular audible warning device includes a primary housing which houses the core components of the audible warning device: a transducer and control circuitry. In one embodiment of the invention, the primary housing is insertable within a variety of secondary housings having a variety of configurations and features in order to accommodate demand for differing configurations and applications. Additionally, the primary housing may be adapted for direct mounting within an aperture formed within a planar member, for instance, a body panel or bumper.

A transducer is attached to and enclosed within the primary housing. In one embodiment of the modular audible warning device, the transducer is configured as a driver inserted within the primary housing. The driver includes a cone, a magnet and a coil. The outer peripheral edge of the cone is attached at the first end of the primary housing with the inner peripheral edge attached to the coil. The cone is nestled within the primary recess of the primary housing. The driver may include a basket supporting the cone, or in the alternative, the primary housing may replace the basket, the primary housing supporting the cone.

To some extent, driver output tone and volume may be varied employing different primary housing configurations. Generally speaking, a correlation has been observed between the internal volume of the recess and driver output tone. Specifically, it has been observed that the larger the volume of the recess into which the driver is inserted, the lower the frequency of the output tone.

In one embodiment of the modular audible warning device, a control circuit is mounted within the primary housing and connected to the transducer. In one embodiment of the invention, the standard alarm mode, the control circuit may be configured to emit a sound having a relatively narrow tonal range. In this standard alarm mode, the control circuit may include a signal generator for producing an electrical signal, a signal conditioner coupled to the signal generator for processing the electrical signal producing a conditioned signal, and an amplifier coupled to the signal conditioner and the driver for amplifying the conditioned signal for emission through the driver.

In the alternative, the control circuit may be programmable being configurable in a variety of operational modes including a preset preselected output mode, a manually adjustable output mode, an automatically adjustable alarm mode, or a multi-frequency horn mode, wherein the control circuit may be configured to mimic a multi-frequency tone.

According to the present invention, the primary housing may be configured having any geometric, symmetrical cross section, for instance a tubular section, a cylindrical section, a rectangular solid section or asymmetrical cross section. Similarly, the secondary housing may take a variety of forms. Either or both the primary and secondary housings may be manufactured employing a variety of materials including plastics and metals. The partition may be configured as a substantially planar element intersecting the primary housing and oriented on a plane lying substantially perpendicular to a longitudinal axis of the primary housing. The primary housing may also include a mounting member for mounting the primary housing assembly within a secondary housing or, in the alternative, within an aperture formed within the body or frame of a piece of equipment. The modular audible warning device and the assembly thereof according to the present invention may include a plurality of interchangeable secondary housings.

Taken individually or in any combination, features of the present invention, include:

- the capability of assembling core components of the warning device in a primary housing that may be employed as the finished product or installed in any number of interchangeable secondary housings;
- the capability of supporting the driver cone directly in the primary housing thereby eliminating the basket as an integral component of the driver;
- the capability of increasing the efficiency and lowering the frequency of the driver by varying the internal volume of the primary recess;
- the capability of including a programmable control circuit which permits the modular audible warning device to operate in a variety of modes including a standard alarm mode, an adjustable alarm mode, an automatically adjustable alarm mode or a multi-frequency horn mode; and the capability of employing modular connectors to permit a wide variety of wiring configurations to permit adaptation of the modular audible warning device to a vast array of vehicle and equipment wiring configurations, resulting in a compact assembly that may be employed and configured to permit use according to a wide variety of customer preferences.

Additional advantages and novel features of the invention will be set forth in part in the description that follows, and in part will become apparent to those skilled in the art upon examination of the following, or may be learned by practice of the invention. The advantages of the invention may be realized and attained by means of the instrumentalities and combinations particularly pointed out in the appended claims.

DETAILED DESCRIPTION OF THE INVENTION

Figure 1:
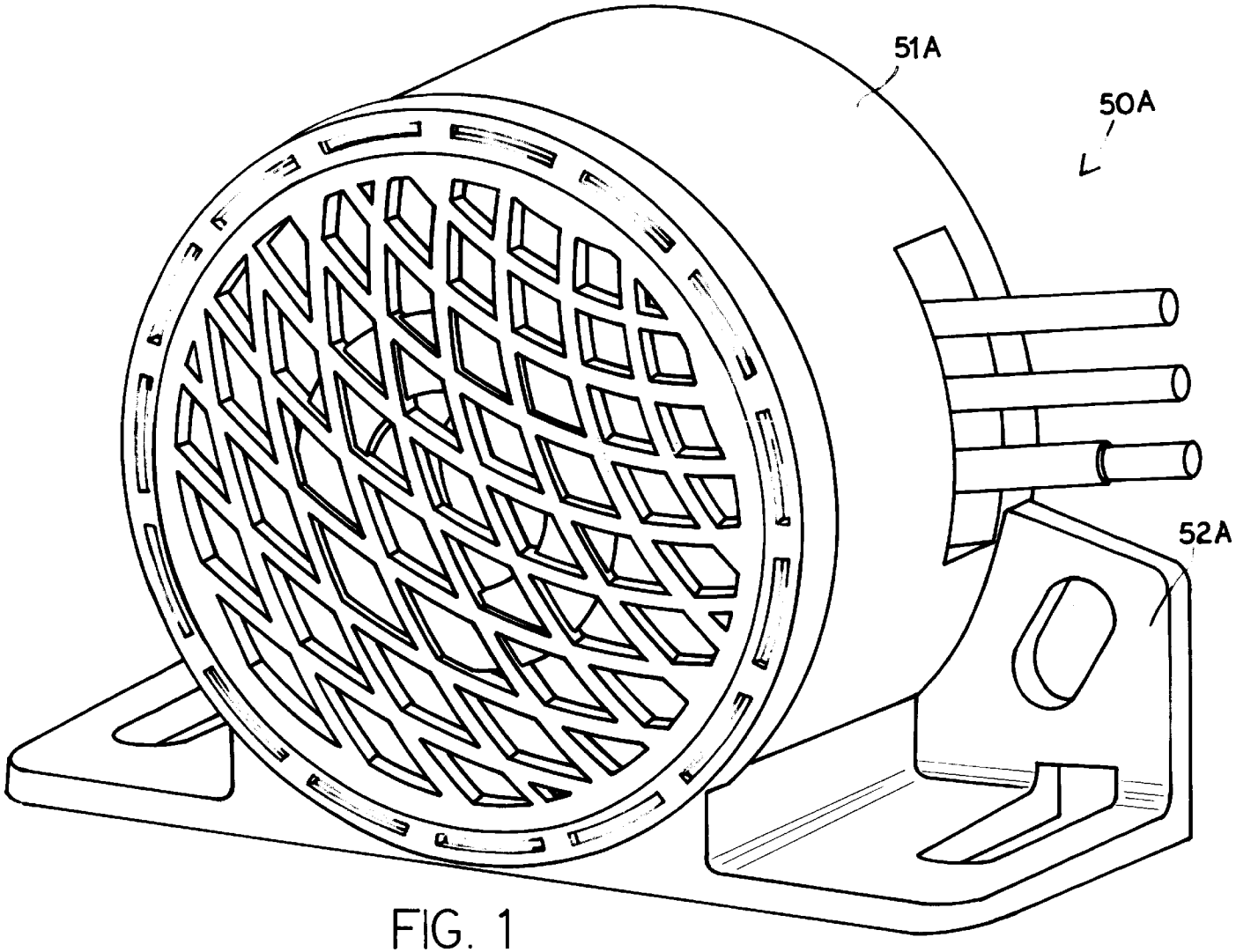
FIG. 1 is a perspective representational view of a modular alarm assembly according to the present invention.

FIG. 1 is a perspective representational view of one embodiment of modular alarm assembly 50A including forward facing driver housing 51A having mounting bracket 52A.

Figure 2:
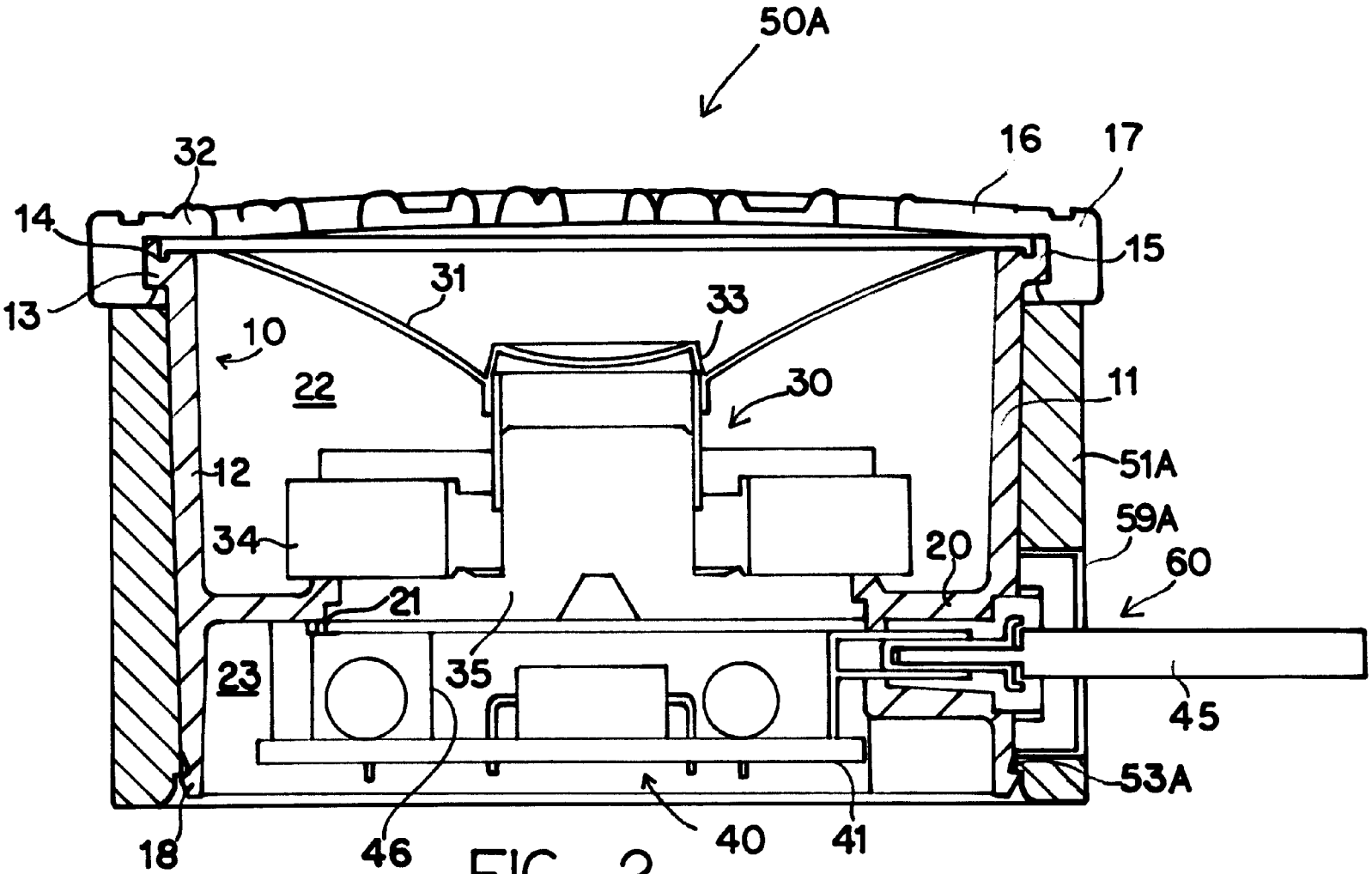
FIG. 2 is a side cut-away view of a portion of the modular alarm assembly according to the present invention.

FIG. 2 is a side cut-away view of modular alarm assembly 50A including forward facing driver housing 51A. Modular alarm assembly 50A is shown including primary housing assembly 10 inserted within forward facing driver housing 51A. The secondary housing in this embodiment of the invention is configured as forward facing driver housing 51A.

Figure 3:
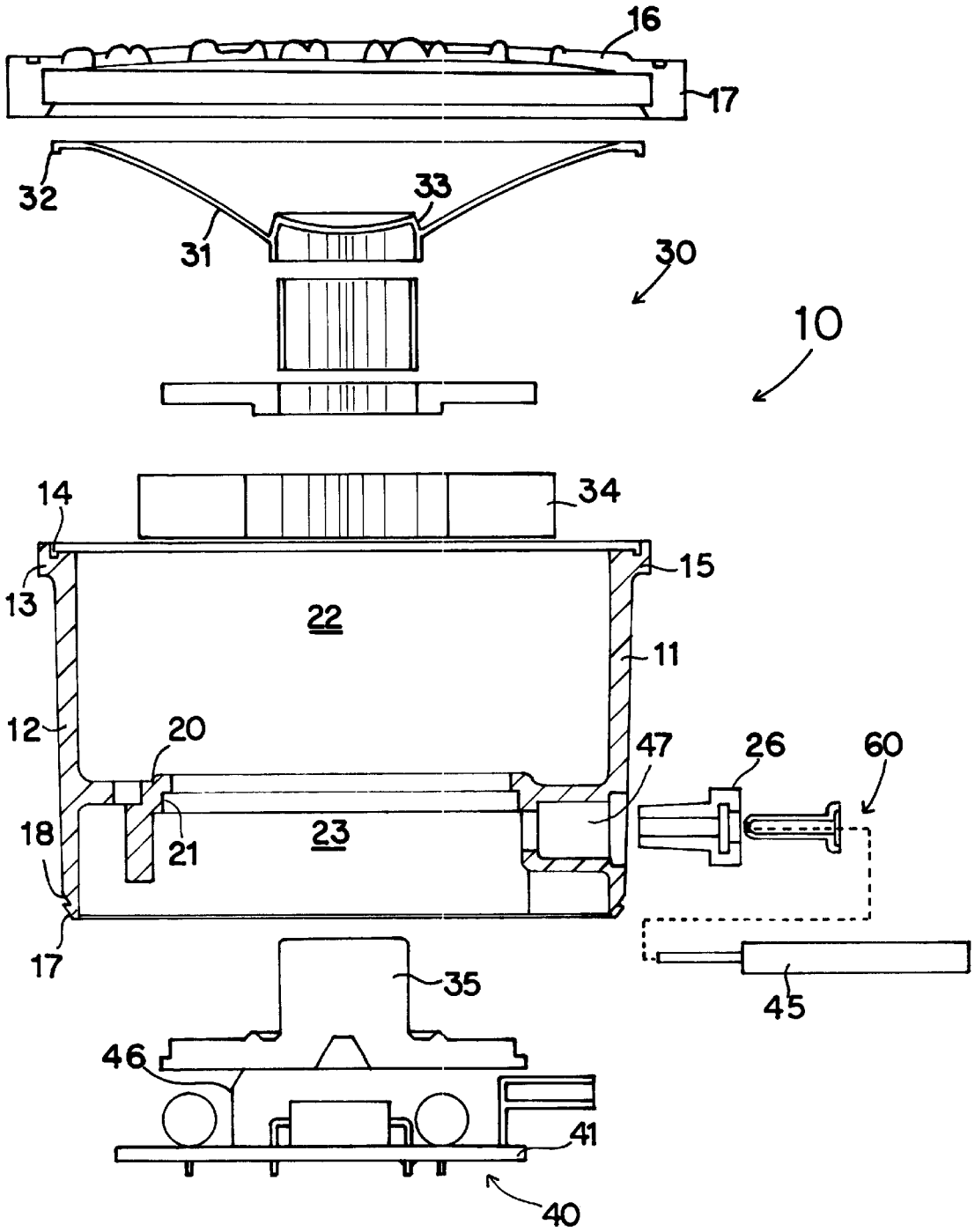
FIG. 3 is a perspective exploded representational view of a modular alarm assembly according to the present invention.

FIG. 3 is an exploded cross-sectional representational drawing of primary housing assembly 10.

Figure 4:
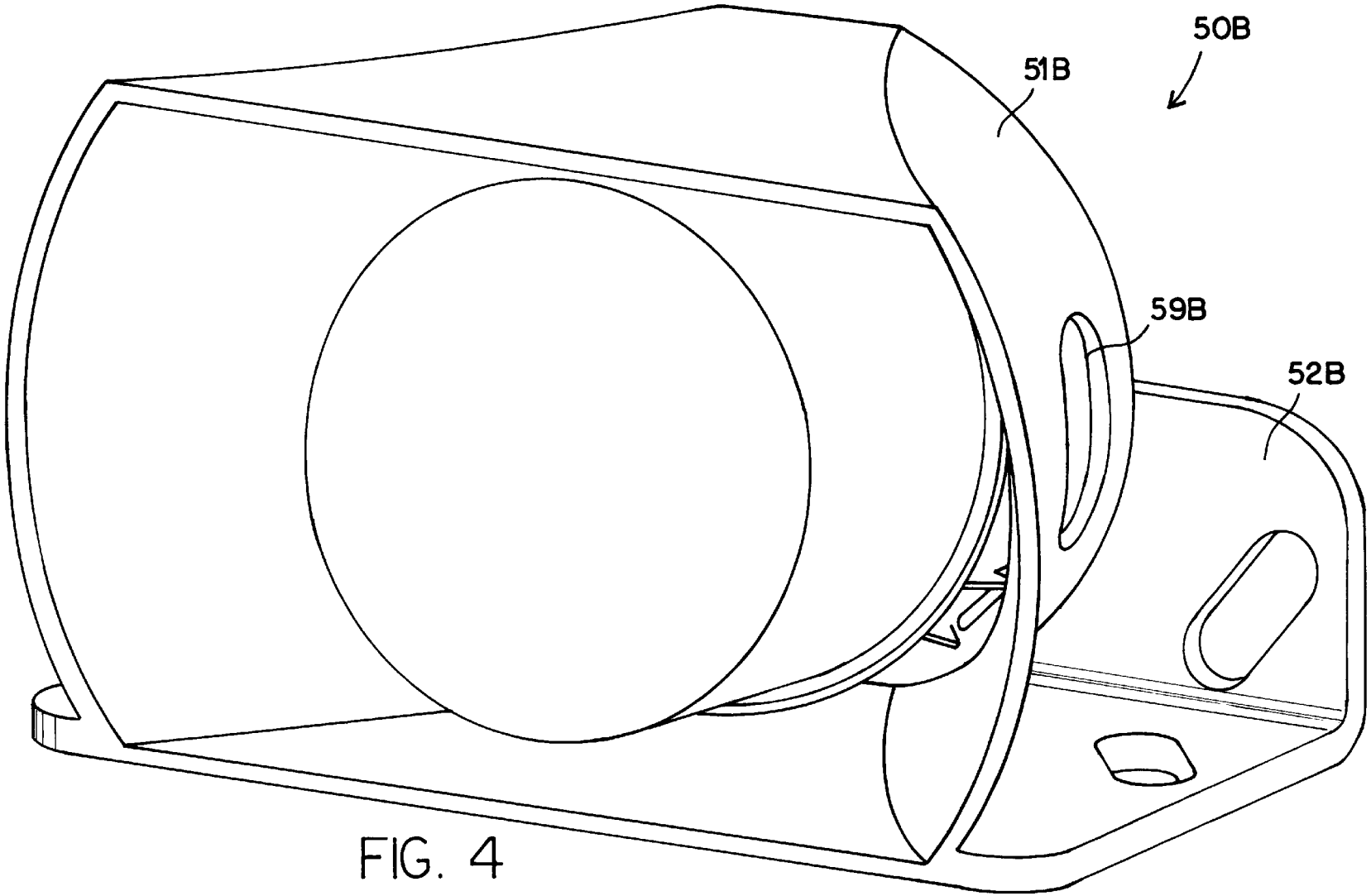
FIG. 4 is a perspective representational view of a modular alarm assembly according to the present invention.

FIG. 4 is a perspective representational view of another embodiment of modular alarm assembly 50B including rearward facing driver housing 51B having mounting bracket 52B.

Figure 5:
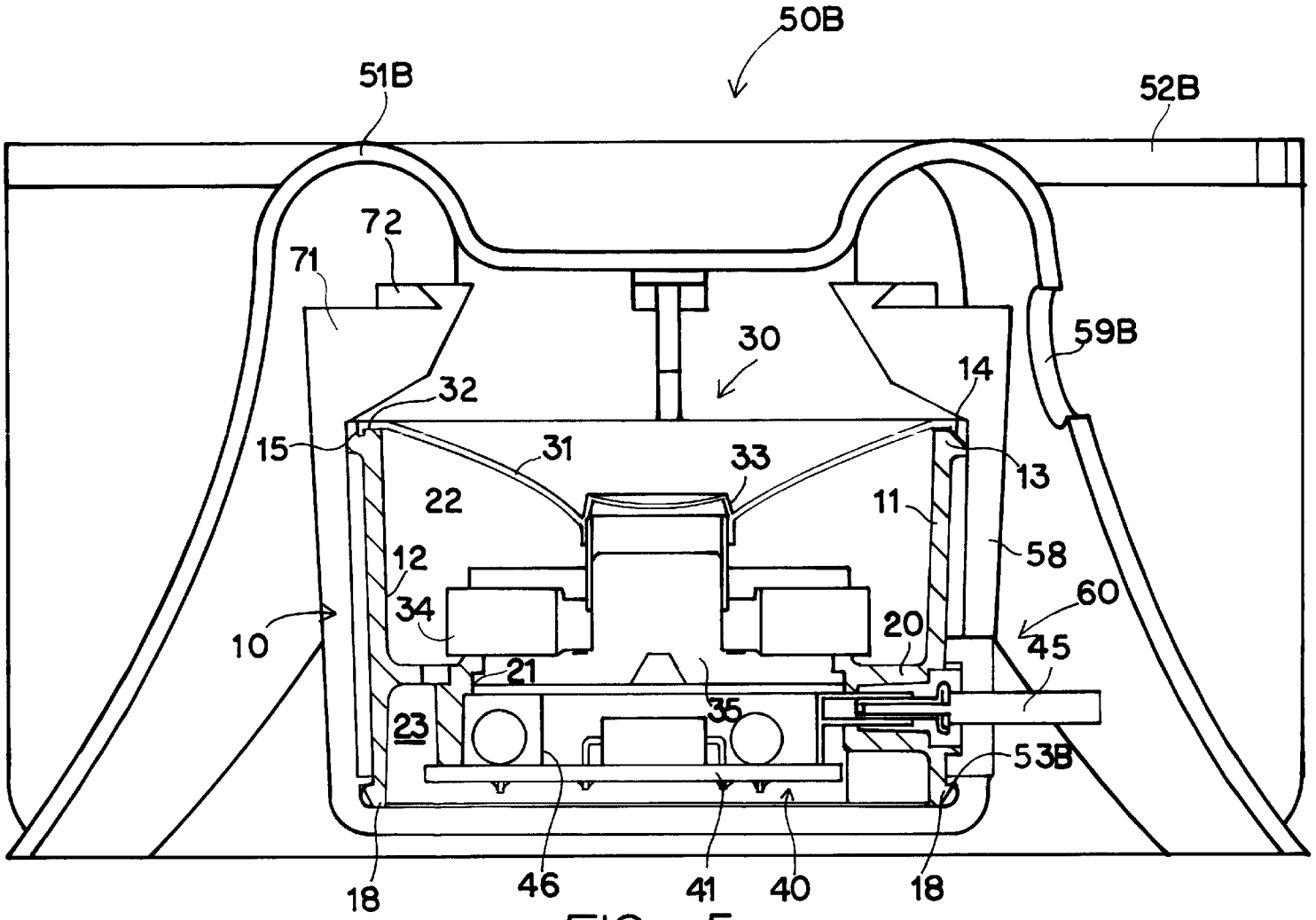
FIG. 5 is a side cut-away view of a portion of the modular alarm assembly according to the present invention.

FIG. 5 is a side cut-away view of modular alarm assembly 50B including primary housing assembly 10 inserted within rearward facing driver housing 51B. The secondary housing in this embodiment of the invention is configured as rearward facing driver housing 51B.

Figure 6:
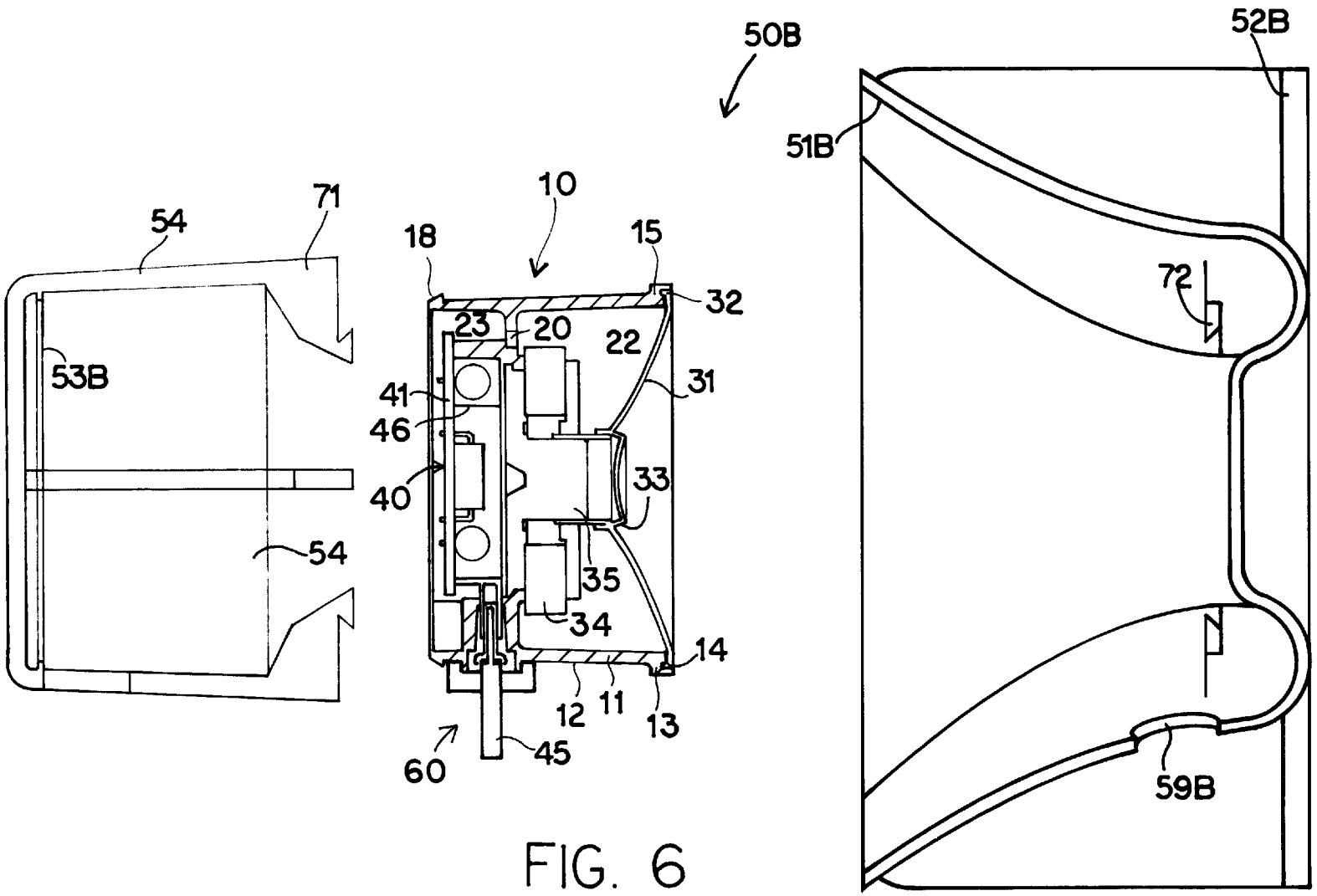
FIG. 6 is a perspective exploded representational view of a modular alarm assembly according to the present invention.

FIG. 6 is an exploded cross-sectional representational drawing of modular alarm assembly 50B including primary housing assembly 10 inserted within nose housing 54 and rearward facing driver housing 51B. Nose cone 54 is supported and attached within rearward facing driver housing 51B on arms 71 which engage mating member 72.

Figure 7:
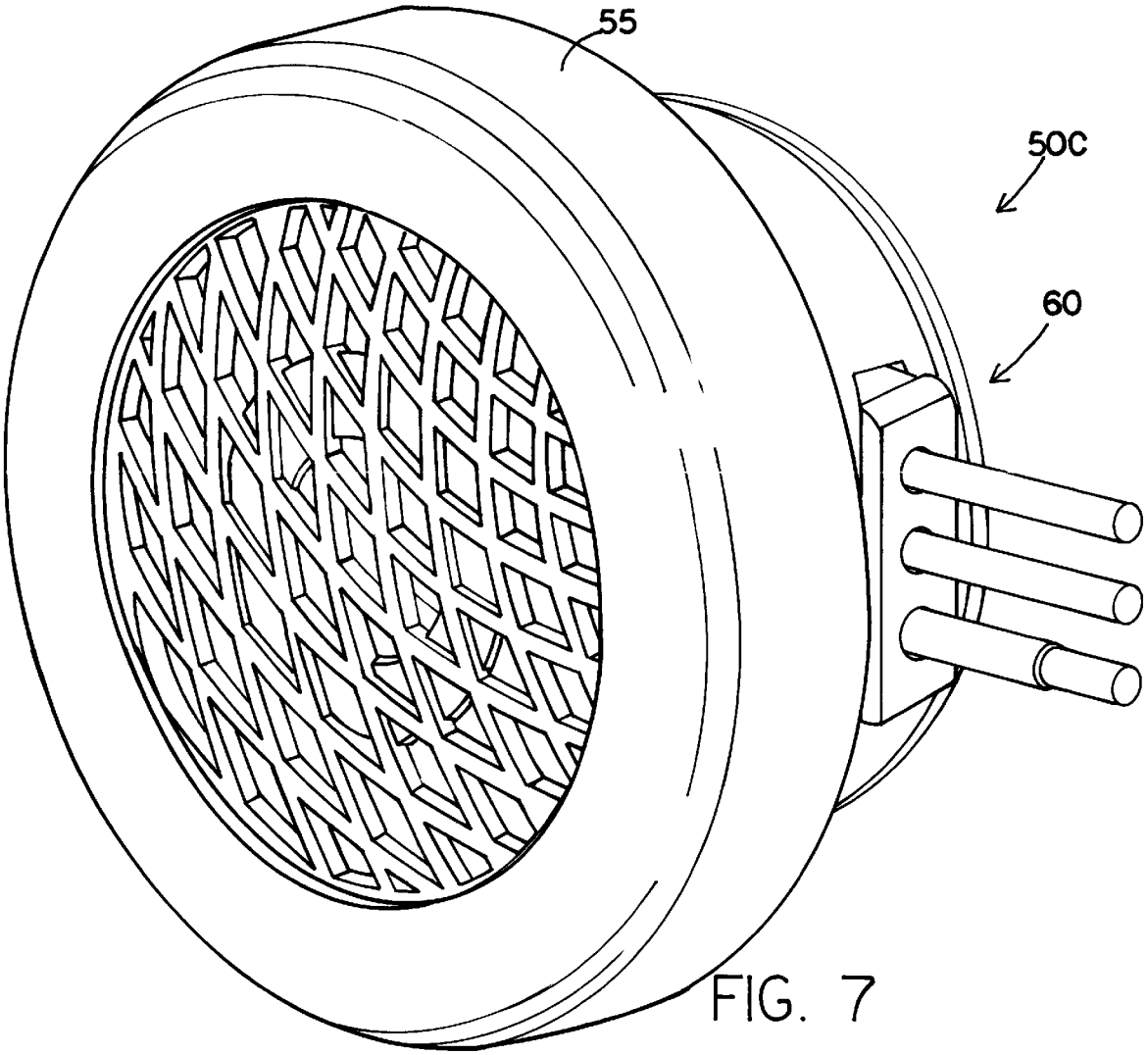
FIG. 7 is a perspective representational view of a modular alarm assembly according to the present invention.

FIG. 7 is a perspective representational view of one embodiment of modular alarm assembly 50C including grommet 55 for mounting modular alarm assembly 50C within an aperture.

Figure 8:
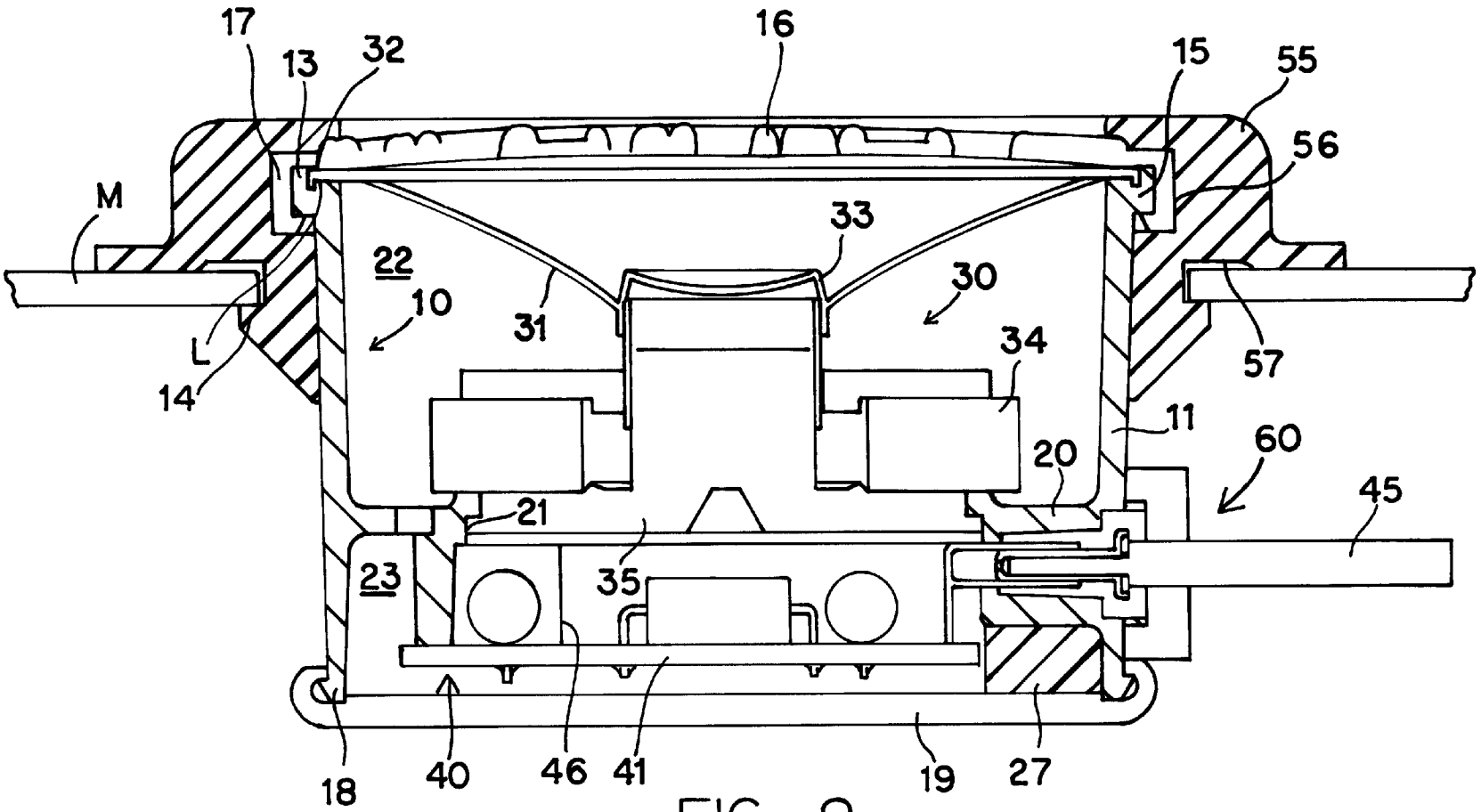
FIG. 8 is a side cut-away view of a portion of the modular alarm assembly according to the present invention.

FIG. 8 is a side cut-away view of modular alarm assembly 50C including primary housing assembly 10. In this embodiment of the invention, modular alarm assembly 50C does not include a secondary housing, Rather, modular alarm assembly 50C is deployed by mounting within an aperture formed within mounting surface M and having lip L. This feature of the invention is achieved utilizing grommet 55 for mounting modular alarm assembly 50C.

Figure 9:
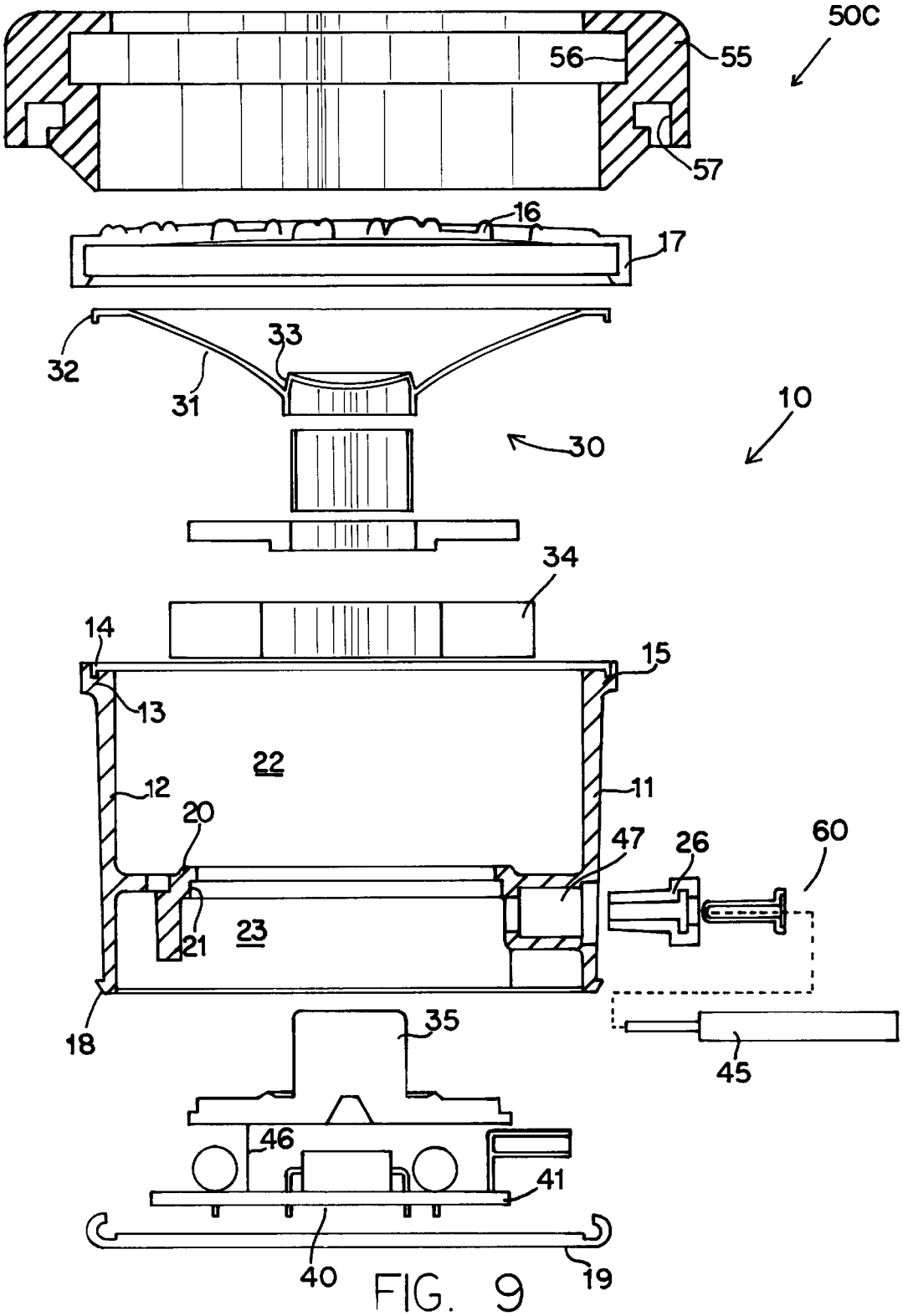
FIG. 9 is a perspective exploded representational view of a modular alarm assembly according to the present invention.

FIG. 9 is a perspective exploded representational view of modular alarm assembly 50C including primary housing assembly 10.

Referring to FIGS. 2, 3, 5, 6, 8 and 9, primary housing assembly 10 includes primary housing 11 having primary housing wall 12 which includes first end 13 configured to include cone attachment face 14.

Primary housing 11 is configured having a peripheral mounting member, in this case groove 18, which in FIG. 2, engages housing connection flange 53A of forward facing driver housing 51A. As shown in FIGS. 5 and 6, groove 18 engages housing connection flange 53B of rearward facing driver housing 51B. Alternatively, as shown in FIGS. 8 and 9, groove 18 engages cap 19.

Primary housing 11 is also configured having partition 20. Partition 20 divides primary housing 11 into primary recess 22 and secondary recess 23.

Referring to FIGS. 2, 5 and 8, driver 30 is shown installed within primary housing 11. FIG. 2 shows outer peripheral edge 32 of cone 31 attached along cone attachment face 14 of primary housing 11. Inner peripheral edge 33 of cone 31 attaches to coil 35 which inserts within magnet 34. Magnet 34 is held within primary housing 11 by partition 20. Magnet 34 is inserted within secondary recess 23 and compressively held within groove 21 of partition 20.

Referring to FIG. 2, first conductor 45 passes through forward facing driver housing 51A at conductor aperture 59A to connector well 47, passing into secondary recess 23. Referring to FIG. 4–6, conductor aperture 59B provides a passage for first conductor 45 through rearward facing driver housing 51B.

Referring again to FIG. 8, secondary recess 23 may be filled with a weatherproofing and sealing compound for weatherproofing and sealing the control circuit within secondary recess 23. In this case, secondary recess 23 is filled with epoxy compound 27 following installation and assembly of magnet 34 and control circuit 40.

Figure 11:
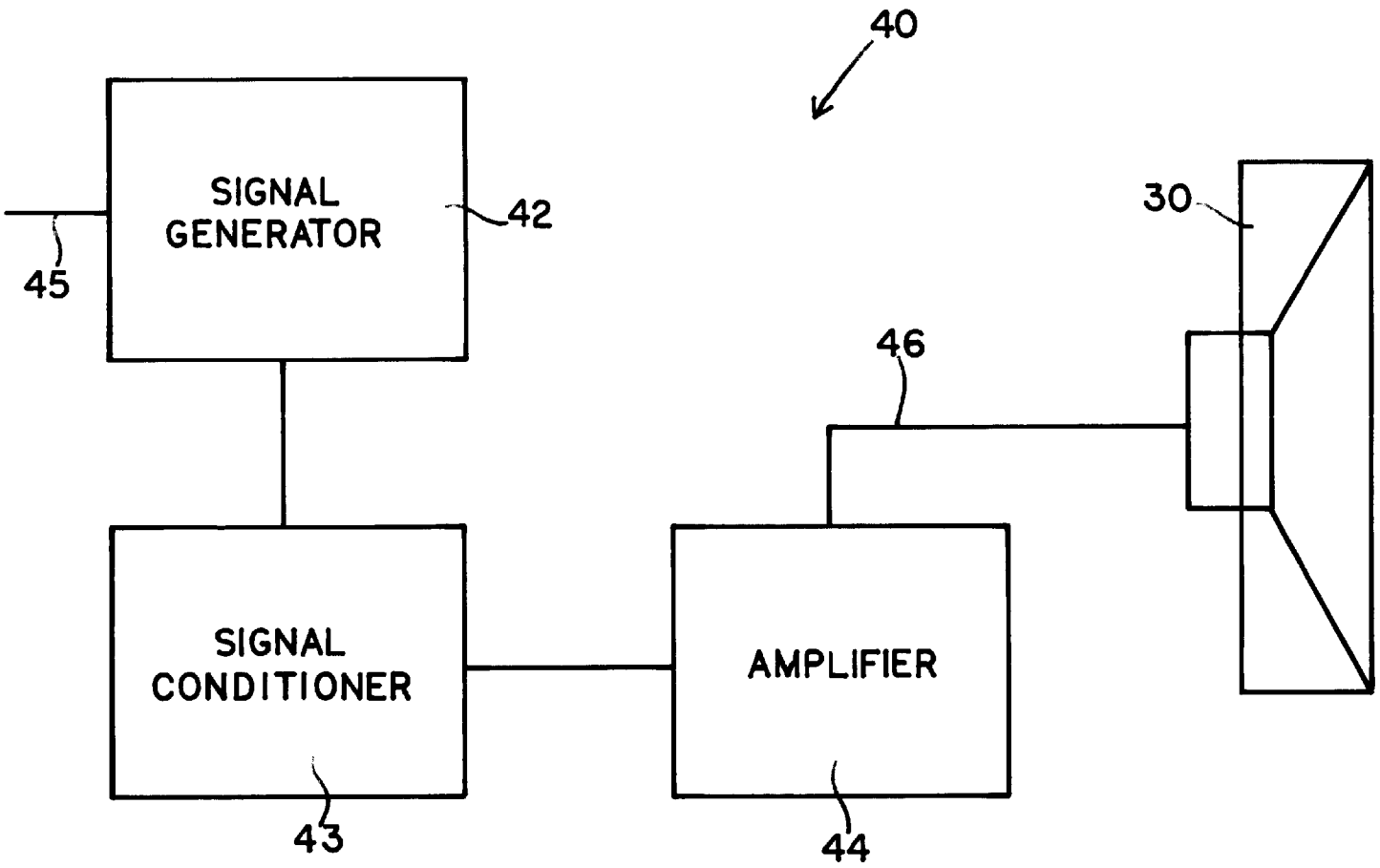
FIG. 11 is a logic block diagram of circuitry for generating an audible tone according to the present invention.

Also supported within secondary recess 23 is control circuit 40 including circuit board 41. As shown in FIG. 11, a system logic block diagram of one embodiment of control circuit 40 is configured to include signal generator 42 for producing an electrical signal, signal conditioner 43 coupled to signal generator 42 for processing the electrical signal producing a conditioned signal and amplifier 44 coupled to signal conditioner 43 and driver 30 for amplifying the conditioned signal for emission through driver 30. Control circuit 40 is connected to driver 30 by second conductor 46, (shown in FIG. 2). First conductor 45 connects the control circuit to a power supply and second conductor 46 connects the control circuit to the transducer. First conductor 45 comprises a portion of modular conductor assembly 60.

Primary housing assembly 10 includes primary attachment flange 15, which as shown in FIGS. 2, 3, 8 and 9, grill 16 attaches. As shown in FIGS. 8 and 9, a resilient attachment member, grommet 55 is placed about secondary attachment flange 17 of grill 16 and includes inner peripheral slot 56 for engaging secondary attachment flange 17 of grill 16 and outer peripheral slot 57 for engaging lip L, as shown at FIG. 8.

Figure 10:
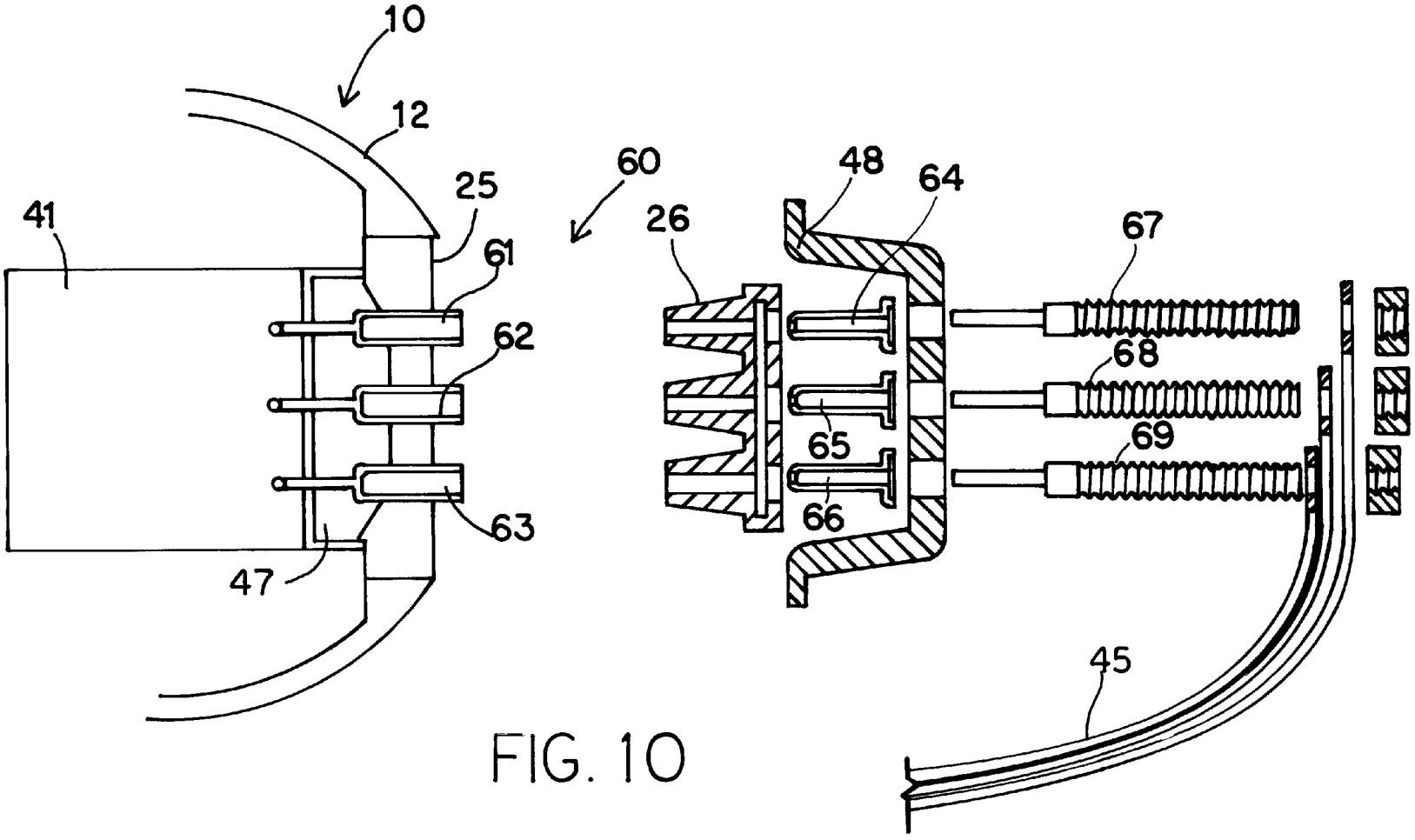
FIG. 10 is an exploded representational view of a connector assembly according to the present invention.

FIGS. 1–10 show modular conductor assembly 60. As shown at FIG. 10, modular conductor assembly 60 includes first connector member 61, second connector member 62 and third connector member 63 which are secured within connector well 47 and which are conductively connected to circuit board 41. First conductor 45 includes fourth connector member 64, fifth connector member 65 and sixth connector member 66. First stud 67, second stud 68 and third stud 69 are insertable within and secured to fourth connector member 64, fifth connector member 65 and sixth connector member 66 respectively.

In order to make a weather tight conductive connection, conductor seal 26 engages first connector member 61, second connector member 62 and third connector member 63. Fourth connector member 64, fifth connector member 65 and sixth connector member 66 insert within and engage first connector member 61, second connector member 62 and third connector member 63 respectively. First stud 67, second stud 68 and third stud 69 are insertable within fourth connector member 64, fifth connector member 65 and sixth connector member 66 respectively. Retainer 48 holds the various components of modular conductor assembly 60 in compressive engagement.

In alternate embodiments of the invention, modular conductor assembly 60 may assume a wide variety of configurations.

In use, primary housing assembly 10 may be manufactured in such a manner as to be compatible with, and hence be capable of, taking on any of a variety of final product configurations by being inserted at the end of the manufacturing process in any of a variety of secondary housings including those represented herein. Control circuit 40 may be configured so as to be adaptable and programmable in one of the final manufacturing processes to perform in any of a variety of operational modes. In addition, any of a variety of modular conductor assemblies 60 may be included depending upon the requirements of customer needs.

A method for the assembly of a modular alarm assembly includes the steps of manufacturing a primary housing assembly including a primary housing, a transducer attached to and enclosed within the primary housing and a control circuit attached to and enclosed within the primary housing, the control circuit conductively connected to the transducer and inserting the primary housing assembly within a secondary housing.

Alternately, the method for the manufacturing a modular alarm assembly may include the additional steps of manufacturing the primary housing assembly including a programmable control circuit conductively connected to the transducer and programming the control circuit to perform in one of a plurality of operational modes. Alternately, the method for the manufacturing a modular alarm assembly may include the additional step of conductively attaching a modular conductor assembly to the modular alarm assembly.

While this invention has been described with reference to the described embodiments, this is not meant to be construed in a limiting sense. Various modifications to the described embodiments, as well as additional embodiments of the invention, will be apparent to persons skilled in the art upon reference to this description, the drawings and the appended claims.

It is therefore contemplated that the appended claims will cover any such modifications or embodiments as fall within the scope of the invention.

I claim:

1. A modular audible warning device comprising:

a primary housing including a substantially planar partition oriented on a plane lying substantially perpendicular to a longitudinal axis of the primary housing, the partition defining a primary recess and a secondary recess;

a transducer attached to and enclosed within the primary housing; and a control circuit attached to and enclosed within the primary housing, the control circuit conductively connected to the transducer.

2. The modular audible warning device of claim 1 wherein the primary housing further comprises a geometric section.

3. The modular audible warning device of claim 1 wherein the primary housing further comprises a cylindrical section.

4. The modular audible warning device of claim 1 wherein the primary housing further comprises a primary attachment flange.

5. The modular audible warning device of claim 4 wherein the primary housing further comprises a grill attached to the primary attachment flange.

6. The modular audible warning device of claim 5 wherein the grill further comprises a secondary attachment flange.

7. The modular audible warning device of claim 6 further comprising a resilient attachment member attached to the secondary attachment flange.

8. The modular audible warning device of claim 1 wherein the transducer further comprises:

a driver including a cone;

a coil, an inner peripheral edge of the cone attached to the coil; and a magnet attached to the partition, the magnet arranged about the coil.

9. The modular audible warning device of claim 8 wherein the driver further comprises the cone having an outer peripheral edge attached at the first end of the primary housing, the primary housing supporting the cone.

10. The modular audible warning device of claim 1 wherein the control circuit further comprises:

a signal generator for producing an electrical signal;

a signal conditioner coupled to the signal generator for processing the electrical signal producing a conditioned signal; and an amplifier coupled to the signal conditioner and the driver for amplifying the conditioned signal for emission through the driver.

11. The modular audible warning device of claim 1 wherein the control circuit further comprises a programmable control circuit.

12. The modular audible warning device of claim 1 further comprising a secondary housing, the primary housing insertable within the secondary housing.

13. The modular audible warning device of claim 1 further comprising a plurality of interchangeable secondary housings, the primary housing insertable within any of the plurality of interchangeable secondary housings.

14. The modular audible warning device of claim 1 further comprising a weatherproofing and sealing compound weatherproofing and sealing the control circuit within the primary housing.

15. A method for the manufacturing a modular alarm assembly includes the steps of:

manufacturing a primary housing assembly including a primary housing, the primary housing including a substantially planar partition oriented on a plane lying substantially perpendicular to a longitudinal axis of the primary housing, the partition defining a primary recess and a secondary recess, a transducer attached to and enclosed within the primary housing and a control circuit attached to and enclosed within the primary housing, the control circuit conductively connected to the transducer; and inserting the primary housing assembly within a secondary housing.

16. The method for the manufacturing a modular alarm assembly of claim 15 further comprising the steps of:

manufacturing the primary housing assembly including a programmable control circuit conductively connected to the transducer; and programming the control circuit to perform in one of a plurality of operational modes.

17. The method for the manufacturing a modular alarm assembly of claim 15 further comprising the step of conductively attaching a modular conductor assembly to the modular alarm assembly.

* * * * *